US006860277B2

(12) United States Patent
Lee et al.

(10) Patent No.: US 6,860,277 B2
(45) Date of Patent: Mar. 1, 2005

(54) SINGLE TYPE OF SEMICONDUCTOR WAFER CLEANING DEVICE

(75) Inventors: Kun-tack Lee, Suwon (KR); Yong-pil Han, Seoul (KR); Sang-rok Hah, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 378 days.

(21) Appl. No.: 10/017,415

(22) Filed: Dec. 18, 2001

(65) Prior Publication Data

US 2002/0108641 A1 Aug. 15, 2002

(30) Foreign Application Priority Data

Feb. 10, 2001 (KR) ..... 2001-6623

(51) Int. Cl.[7] ..... B08B 3/00

(52) U.S. Cl. ..... 134/153; 134/148; 134/182; 134/183; 134/902

(58) Field of Search ..... 134/148, 153, 134/182, 183, 902, 99.1

(56) References Cited

U.S. PATENT DOCUMENTS 5,964,954 A * 10/1999 Matsukawa et al. ..... 134/6

6,444,047 B1 * 9/2002 Miyazaki ..... 134/36

FOREIGN PATENT DOCUMENTS

JP 11-054472 * 2/1999

* cited by examiner

*Primary Examiner*—Zeinab El-Arini

(74) *Attorney, Agent, or Firm*—Volentine Francos & Whitt, PLLC

(57) ABSTRACT

A semiconductor wafer cleaning apparatus includes a gas spraying unit, having a gas injection tube and a gas guard extending therearound, for spraying cleaning gas into a water layer formed on a wafer. The gas guard forms a small chamber just above the water layer, so that the partial pressure of gas injected from the gas injection tube is increased in the small chamber, whereupon the cleaning gas readily dissolves in the water layer. As a result, a cleaning solution having a high concentration of cleaning gas is produced, whereby the cleaning efficacy of the solution is high. Subsequently, a drying gas, such as isopropyl alcohol, for drying the wafer can be ejected onto the water layer using the gas spraying unit. Thus, the semiconductor wafer cleaning apparatus has a simple structure.

20 Claims, 4 Drawing Sheets

SINGLE TYPE OF SEMICONDUCTOR WAFER CLEANING DEVICE

BACKGROUND OF THE INVENTION

1. Field of the Invention

The present invention relates to a semiconductor wafer cleaning apparatus. More particularly, the present invention relates to a single type of semiconductor wafer cleaning apparatus and to a method of cleaning a semiconductor wafer using the same.

2. Description of the Related Art

In general, semiconductor wafer cleaning apparatuses include batch and single types. In the batch type of semiconductor wafer cleaning apparatus, several semiconductor wafers are cleaned simultaneously. Although the production efficiency of the batch type of semiconductor cleaning apparatus is high, the cleaning efficacy is low. On the contrary, in the single type of semiconductor wafer cleaning apparatus, the production efficiency is low, and the cleaning efficacy is high. When manufacturing highly-integrated semiconductor devices it is important that the semiconductor wafer be very clean at several stages in the process. Thus, the single type of semiconductor wafer cleaning apparatus is preferred over the batch type.

Also, ozone ($O_3$) has been used to increase the cleaning efficacy of conventional semiconductor wafer cleaning apparatuses. Semiconductor wafer cleaning apparatuses using ozone ($O_3$) include a normal bath type of semiconductor wafer cleaning apparatus that uses a solution containing ozone ($O_3$), a spray type of semiconductor wafer cleaning apparatus that uses ozone ($O_3$) in a gaseous state, and a vapor type of semiconductor wafer cleaning apparatus that uses a mixture of vapor and ozone ($O_3$).

In the bath type of semiconductor wafer cleaning apparatus, the cleaning solution is saturated when the concentration of the ozone ($O_3$) is in the range of 10–20 ppm at room temperature. Thus, it is difficult to use ozone ($O_3$) in high concentrations and at high temperatures in a bath type of semiconductor wafer cleaning apparatus. In the spray type semiconductor wafer cleaning apparatus, a semiconductor wafer is rotated while de-ionized water is sprayed to form a layer of water thereon. Subsequently, the ozone ($O_3$) concentration in the layer of water is increased by spraying ozone ($O_3$) into the chamber, whereby the semiconductor wafer is cleaned. However, in the spray type semiconductor wafer cleaning apparatus, the thickness of the water layer as a means of diffusing the ozone ($O_3$) is proportional to the rate of rotation of the semiconductor wafer. Accordingly, the spray nozzle must be complex so that the ozone ($O_3$) can be sprayed uniformly over the entire surface of the semiconductor wafer. In the vapor type of semiconductor wafer cleaning apparatus, ozone ($O_3$) and vapor are mixed, and the mixture is sprayed onto a semiconductor wafer. In this way, the ozone ($O_3$) is diffuses into vapor molecules attached to the semiconductor wafer, whereby the ozone ($O_3$) concentration can be increased by tens of thousands of ppm. However, in the vapor type of semiconductor wafer cleaning apparatus, the ozone ($O_3$) is used under high pressure in a sealed chamber, and vapor adheres to sides of the chamber.

SUMMARY OF THE INVENTION

An object of the present invention is to overcome the problems, disadvantages and limitations of the prior art. More specifically, it is a first object of the present invention to provide a single type of semiconductor wafer cleaning apparatus having a simple structure, capable of producing a cleaning solution having a high concentration of ozone ($O_3$), and capable of producing other various cleaning solutions. It is likewise a second object of the present invention to provide a method of cleaning a semiconductor wafer with a high degree of efficacy.

To achieve the first object, the single type of semiconductor wafer cleaning apparatus includes a rotary chuck on which a wafer is mounted, a de-ionized water supply means for supplying de-ionized water onto the wafer to form a layer of water on the wafer, and a gas spray unit disposed above the chuck and including a gas injection tube for spraying gases including a cleaning gas onto the layer of water, and a gas guard extending from the gas injection tube and forming a small chamber in which the gas is sprayed onto the layer of water.

Preferably, the gas spray unit can be moved forward and backward and to the right and left relative to the wafer. The gas guard has a frusto-conical portion through which exhaust holes are formed. A megasonic transducer is attached to the gas spraying unit for transmitting supersonic waves into the layer of water via the gas guard.

The apparatus further includes gas supply means for supplying gases to the gas injection tube. The gases can include ozone ($O_3$), hydrofluoric acid (HF), ammonia ($NH_3$), carbon dioxide ($CO_2$), sulfur oxide ($SO_2$), hydrogen ($H_2$), nitrogen ($N_2$), argon (Ar), isopropyl alcohol (IPA), or a combination of these gases. The gas supply means preferably includes a mixer for mixing a plurality of the gases.

In order to achieve the second object, a method of cleaning a semiconductor wafer includes steps of mounting a wafer to a rotary chuck within a chamber, spraying de-ionized water onto the wafer while rotating the chuck to form a layer of water on the wafer, providing a gas guard defining a chamber having an open bottom just over the layer of water on the wafer (e.g., 2–4 mm from the water layer), and spraying a cleaning gas through the chamber and onto the layer of water whereupon the cleaning gas dissolves in the water and produces a cleaning solution having a high concentration of the cleaning gas.

The gas spray and gas guard can be moved across the surface of the wafer to "scan" the layer of water with the spray of cleaning gas. Preferably, the internal pressure of the chamber formed by the gas guard is maintained between 1–2 atm. Subsequently, a drying gas is injected into the layer of water on the cleaned wafer, whereby the wafer is dried (the water layer is evaporated). The gas for drying the water layer is preferably isopropyl alcohol (IPA).

BRIEF DESCRIPTION OF THE DRAWINGS

The above and other objects, features and advantages of the present invention will become more apparent by referring to the following detailed description of the preferred embodiments thereof made with reference to the attached drawings, of which.

DETAILED DESCRIPTION OF THE INVENTION

The present invention will be described more fully with reference to the accompanying drawings.

Figure 1:
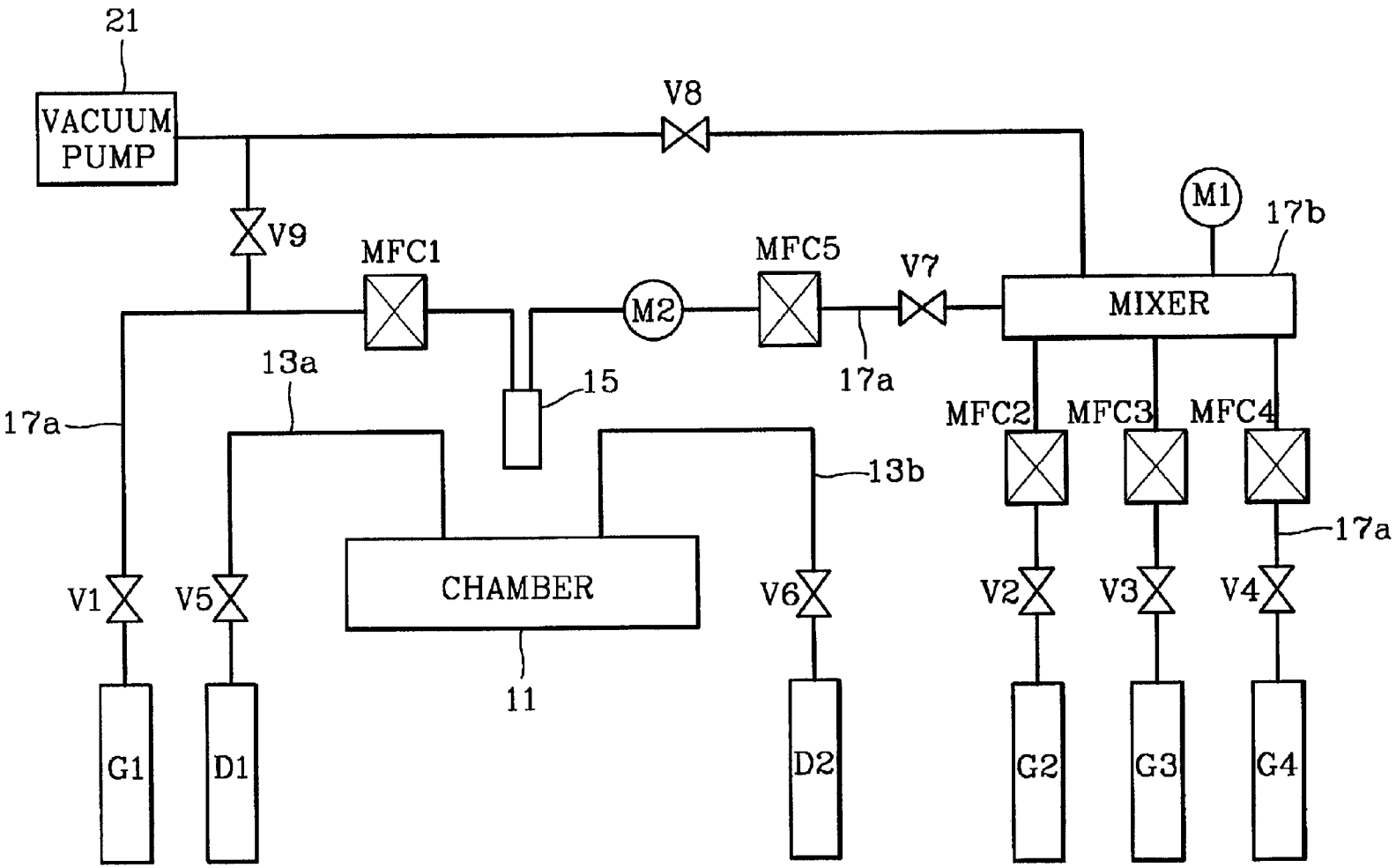
FIG. 1 is a schematic diagram of a single type of semiconductor wafer cleaning apparatus according to the present invention.
Figure 2:
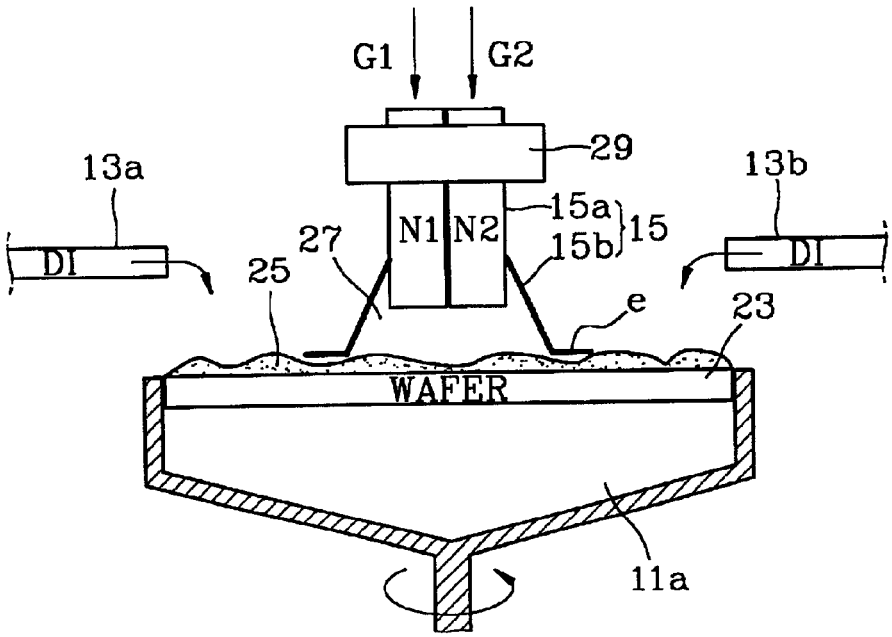
FIG. 2 is a schematic of a portion of the single type of semiconductor wafer cleaning apparatus of FIG. 1 showing a gas spraying unit thereof in more detail.

Referring now to FIGS. 1 and 2, a single type of semiconductor wafer cleaning apparatus according to the present invention includes a chamber 11 into which a wafer 23 is loaded, a rotatable chuck 11*a* disposed in the chamber 11 and to which the wafer 23 is mounted, and a de-ionized water supplying means for supplying de-ionized water onto the wafer from the side(s) of the chamber 11. The de-ionized water supplying means includes de-ionized water supply sources D1 and D2, valves V5 and V6, and at least one and preferably, two or more, de-ionized water supply lines 13*a* and 13*b*.

The semiconductor wafer cleaning apparatus also includes a gas spraying unit 15 for spraying gas towards the wafer, and a gas supply means for supplying gases to the gas spraying unit 15. The gas supply means includes gas supply sources G, a gas line 17*a*, valves V1 through V4 and V7 through V9, mass flow controllers MFC1 through MFC5, gas measuring gauges M1 and M2, and a mixer 17*b*. For ease of explanation, only four gas supply sources G1 through G4 are illustrated although more may be provided. The mixer 17*b* mixes gases supplied from the gas supply sources G1 through G4 and supplies the mixed gases to the gas spraying unit 15. Gases not used among the gases supplied from the gas supply sources G1 through G4 are exhausted by a vacuum pump 21.

The gas supply sources G1 through G4 can be sources of ozone ($O_3$), hydrofluoric acid (HF), ammonia ($NH_3$), carbon dioxide ($CO_2$), sulfur oxide ($SO_2$), hydrogen ($H_2$), nitrogen ($N_2$), argon (Ar), or isopropyl alcohol (IPA). The gases supplied by the gas supply means include a cleaning gas (for example, ozone ($O_3$), hydrofluoric acid (HF), ammonia ($NH_3$), sulfur oxide ($SO_2$), carbon dioxide ($CO_2$), and hydrogen ($H_2$)), a carrier gas (for example, nitrogen ($N_2$) and argon (Ar)), and a dry gas (for example, IPA).

Although the chamber 11 and the gas spraying unit 15 are shown in FIG. 1 as separated from each other, the gas spraying unit 15 can be installed inside the chamber 11. In either case, the crux of the single type of semiconductor wafer cleaning apparatus has a simple structure comprised of the gas spraying unit 15, the gas supply means, and the de-ionized water supply means.

Figure 3:
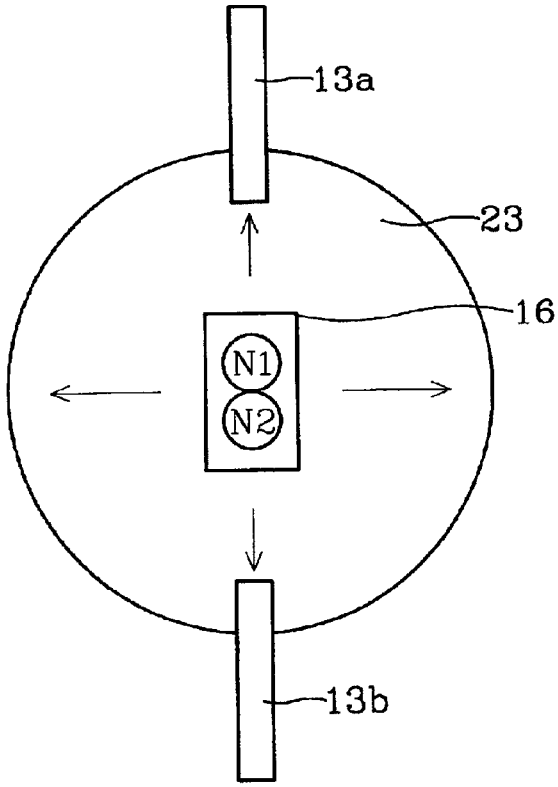
FIG. 3 is a plan view of that portion of the single type of semiconductor wafer cleaning apparatus shown in FIG. 2.

Referring now to FIGS. 2 and 3, de-ionized water is supplied from the de-ionized water supplying lines 13*a* and 13*b* onto the wafer 23, thereby forming a layer of water 25 on the wafer. The gas spraying unit 15 includes a gas injection tube 15*a* and a gas guard 15*b*. The gas injection tube 15*a*, in turn, comprises a plurality of nozzles N, e.g. a first nozzle N1 and a second nozzle N2. The gas guard 15*b* defines a small chamber 27 open just above the surface of the wafer 23 mounted to the rotatable chuck 11*a*. More specifically, the gas guard 15*b* is attached to the gas injection tube 15*a* and extends therefrom to a location close to the surface of the water layer 25. For example, the gas guard is positioned so that the distance between the water layer 25 and the bottom of the gas guard 15*b* is in the range of 2–4 mm. The gas injection tube 15*a* and the gas guard 15*b* are formed of Teflon@, stainless steel, gold (Au), or platinum (Pt).

Figure 4:
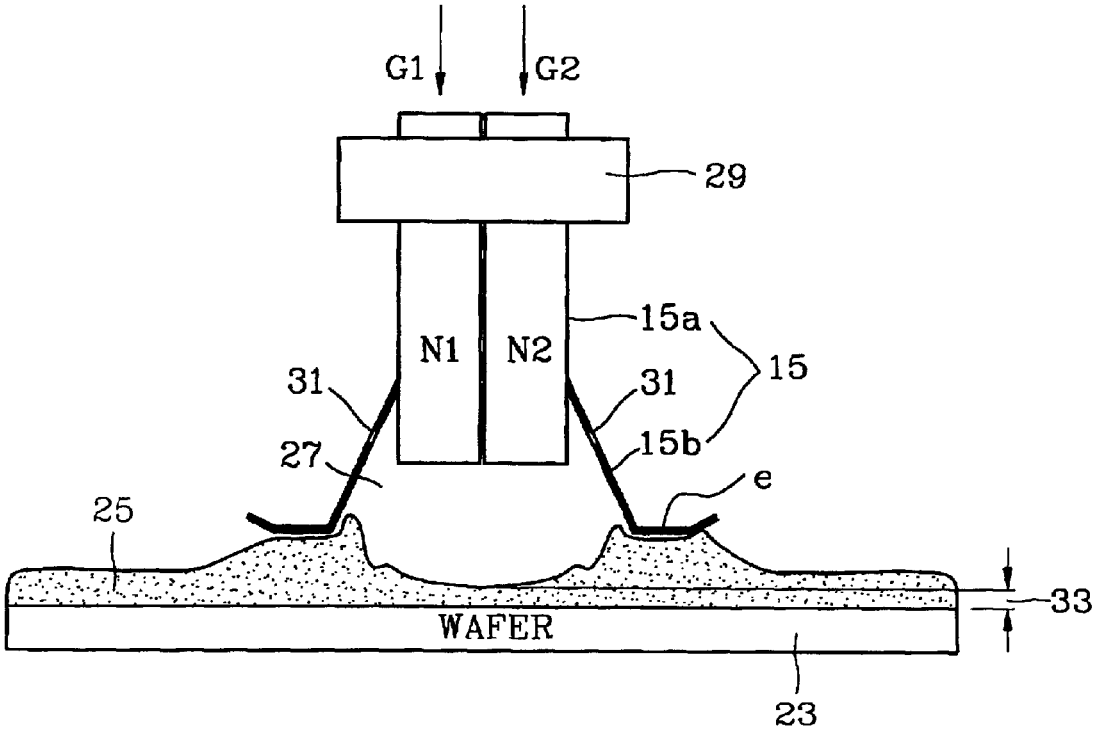
FIG. 4 is an enlarged schematic diagram of the gas spraying unit.
Figure 5:
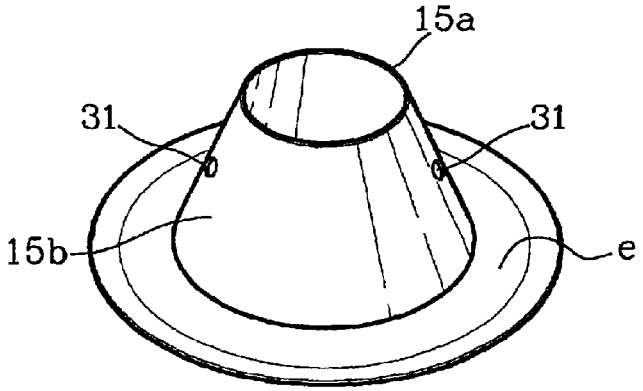
FIG. 5 is a perspective view of a gas guard of the gas spraying unit.

A first gas G1 and a second gas G2 are injected into the gas injection tube 15*a*, but other gases may be injected into the gas injection tube 15*a*, as well. For example, the first gas G1 and the second gas G2 may be ozone ($O_3$), hydrofluoric acid (HF), ammonia ($NH_3$), carbon dioxide ($CO_2$), sulfur oxide ($SiO_2$), hydrogen ($H_2$), nitrogen ($N_2$), argon (Ar), isopropyl alcohol (IPA) or a combination of the same. The first gas G1 and the second gas G2 are injected via the first nozzle N1 and the second nozzle N2, respectively. As best shown in FIGS. 4 and 5, the gas guard 15*b* has a frusto-conical portion having upper and lower openings, with the upper opening being smaller than the lower opening. The gas guard 15*b* further includes a guide member e extending radially outwardly from the bottom of the frusto-conical portion.

As described above, in the single type of semiconductor wafer cleaning apparatus, a small chamber 27 is formed by the gas guard 15*b* close to the water layer 25. The distance between the water layer 25 and the bottom of the gas guard 15*b* is in the range of 2–4 mm. In addition, the gas spraying unit 15 comprising the gas injection tube 15*a* and the gas guard 15*b* can be moved forward and backward and to the right and to the left, that is, in X and Y directions over the wafer 23, as shown in FIG. 3, while in contact with the layer of water 25 on the wafer 23. Any suitable X–Y driving mechanism 16, known per se, can be connected to the gas injection tube 15*a* for this purpose. Gases issuing from the gas injection tube 15*a* reduce the thickness of the water layer 25 under the gas injection tube 15*a*, whereupon the diffusion barrier layer 33 becomes thin. In the case in which the distance between the water layer 25 and the bottom of the gas guard 15*b* is in the range of 2–4 mm, the diffusion barrier layer 33 can be made as thin as several hundreds of micrometers.

Referring again to FIG. 4, the gas guard 15*b* has exhaust holes 31 extending therethrough. The holes 31 define paths through which the air in the small chamber 27 is released, and through which a small quantity of cleaning gas is continuously emitted. Also, the pressure in the small chamber 27 is maintained higher than atmospheric pressure, for example, is maintained between 1–2 atm, by the holes 31. With the interior of the chamber 27 at such a pressure, the atmosphere will not flow back into the gas injection tube 15*a*. The size and number of holes 31 can be selected based on the volume of the small chamber 27 and the amount of cleaning gas emitted by the gas injection tube 15*a*.

The cleaning gas (or mixed gas) supplied from the first nozzle N1 and the second nozzle N2 of the gas injection tube 15*a*, for example, ozone ($O_3$) gas, is sprayed onto the water layer 25 at the bottom of the small chamber 27 and dissolves in the water layer. In this case, the cleaning gas (or mixed gas) has a high partial pressure and the diffusion barrier layer 33 is also thin. Therefore, a large amount of the cleaning gas is dissolved in the water layer 25. The gas spraying unit 15 is scanned across the wafer 23 in the X and Y directions while such a cleaning solution having a high concentration of cleaning gas (for example, a cleaning solution having a high ozone concentration) is produced. Accordingly, impurities are readily removed from the wafer 23. The scanning speed and number of gas spraying units 15 are determined depending on the solubility and etching rate of the gas.

Furthermore, a megasonic transducer 29 is attached to the gas spraying unit 15, thereby finely vibrating the gas spraying unit 15. Accordingly, the supersonic waves are transmitted onto the water layer 25 via the gas guard 15*b*, thereby facilitating the cleaning of the wafer 23. In particular, the supersonic waves facilitate the removal of particles from the wafer 23.

Figure 6:
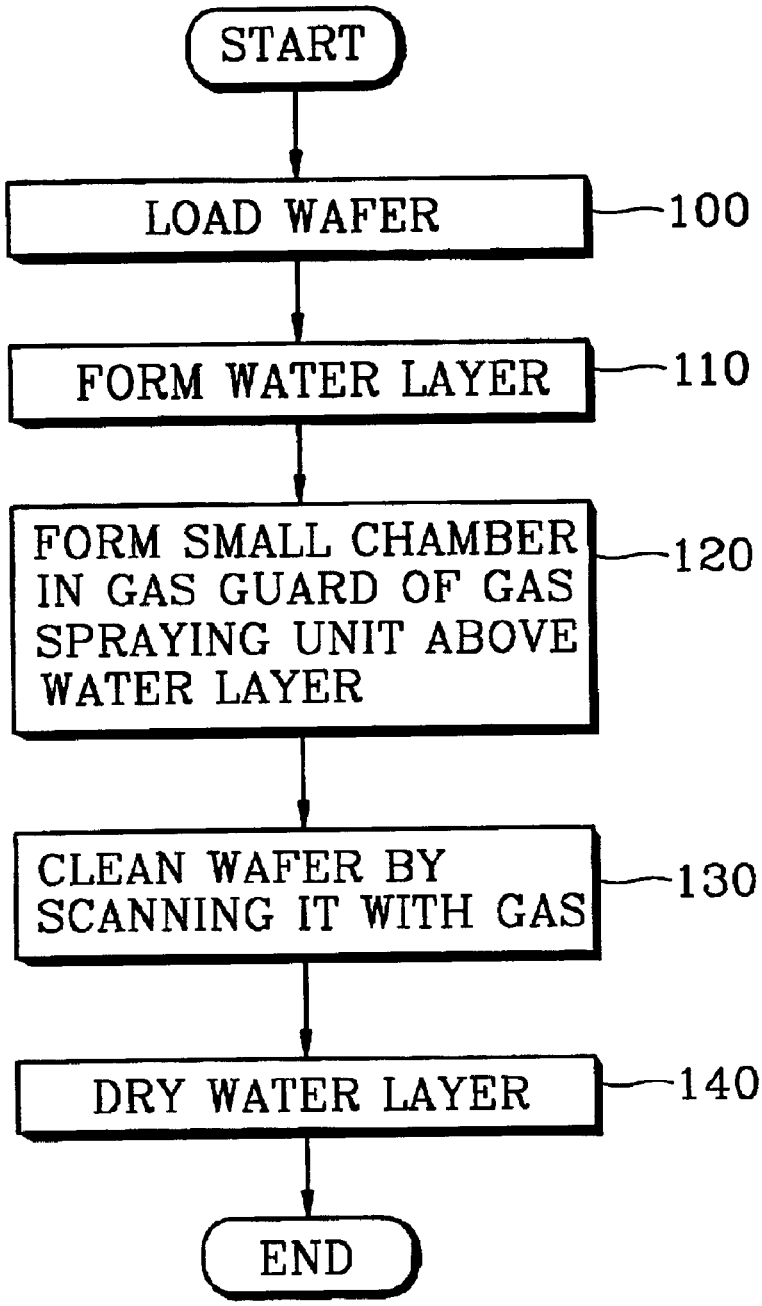
FIG. 6 is a flow chart of a preferred embodiment of a method of cleaning a semiconductor wafer according to the present invention.

FIG. 6 is a flow chart of a method of cleaning a semiconductor wafer using the single type of semiconductor wafer cleaning apparatus according to the present invention. In this method, a wafer 23 is loaded onto a rotary chuck 11*a* (step 100). Subsequently, de-ionized water D1 is sprayed onto the wafer, thereby forming a water layer 25 (step 110). The temperature of the de-ionized water is 10–50° C. The chuck 11*a* is continuously rotated during this water layer-forming process at a rate set according to the amount of de-ionized water being sprayed.

Next, a small chamber 27 is formed over the water layer 25 (step 120). The pressure in the small chamber is maintained between 1–2 atm. The distance between the bottom of the gas guard 15*b* and the water layer 25 is set to be in the range of 2–4 mm. More specifically, the gas spraying unit 15 can be lowered towards the wafer, or the gas spraying unit 15 can be moved laterally over the wafer from a previous position at which the unit was at the desired level above the wafer.

Alternatively, the de-ionized water can be supplied onto the wafer after the gas spraying unit has been positioned over the wafer. In any case, once the water layer is formed, the small chamber 27 is formed over the water layer 25 by the gas guard 15*b* of the gas spraying unit 15.

Subsequently, the gas spraying unit 15 is moved to the right and to the left and forward and backward while a cleaning gas, for example, ozone ($O_3$) gas, is sprayed by the gas spraying unit 15. As a result, the cleaning gas is dissolved in the water layer (step 130). The cleaning gas is formed of a gas selected from ozone ($O_3$), hydrofluoric acid (HF), ammonia ($NH_3$), carbon dioxide ($CO_2$), sulfur oxide ($SO_2$), hydrogen ($H_2$), or a combination of these gases. As described above, the cleaning gas is under high pressure in the small chamber 27, whereby the cleaning gas dissolves into the water layer 25 at a high concentration. Thus, when the gas spraying unit 15 is scanned across the wafer surface, i.e., when the wafer surface on which the water layer 25 has been formed has been scanned with cleaning gas under high pressure, impurities on the wafer are removed effectively. The scanning speed and the number of nozzles N used are determined depending on the solubility and etching rate of the cleaning gas. Of course, during the cleaning process, as occasion demands, the megasonic transducer 29 attached to the gas spraying unit 15 can be activated whereupon supersonic waves are transmitted onto the water layer, thereby increasing the cleaning effect.

Next, the water layer on the cleaned wafer is dried (step 140). The water layer is dried by spraying isopropyl alcohol (IPA) onto the rotating wafer using the gas spraying unit 15. Therefore, that segment of the method from the cleaning step to the drying step can be performed in the same chamber 11.

The rate of rotation of the chuck is set at 5–100 rpm throughout the cleaning step 120, and at 5–1500 rpm during the subsequent IPA drying step 130.

As described above, the present invention can produce a cleaning solution having a high concentration of ozone ($O_3$). Cleaning a wafer using a cleaning solution having a high concentration of a cleaning gas enhances the cleaning efficacy. Furthermore, the megasonic transducer attached to the gas spraying unit can be used to transmit supersonic waves into the water layer, thereby further improving the cleaning efficacy. Also, that period of the method from the cleaning step to the drying step can be performed in one chamber. The single type semiconductor wafer cleaning apparatus thus has a simple structure comprising a gas spraying until made up of a gas injection tube and a gas guard, a gas supplier, and de-ionized water supplier.

Finally, although the present invention has been shown and described with reference to the preferred embodiment thereof, various changes in form and details, as will become apparent to those of ordinary skill in the art, may be made thereto without departing from the true spirit and scope of the invention as defined by the appended claims.

What is claimed is:

1. A single type of semiconductor wafer cleaning apparatus comprising:

a rotary wafer chuck on which a wafer is to be mounted and rotated;

a gas spraying unit disposed above said wafer chuck, said gas spraying unit including a gas injection tube oriented to inject gas towards a wafer mounted to the chuck, and a gas guard connected to the gas injection tube, said gas guard defining a chamber having an open bottom adjacent the rotary chuck;

de-ionized water supply means for supplying de-ionized water onto a wafer at a location outside said chamber when the wafer is mounted to the chuck, to thereby provide a layer of de-ionized water on the wafer; and gas supply means for supplying gases to the gas injection tube such that the gases issue from the tube and are confined by said chamber to thereby reduce the thickness of the layer of de-ionized water provided by the de-ionized water supply means on the wafer, whereby dissolving of the gases into the layer of water is facilitated on the wafer.

2. The apparatus of claim 1, and further comprising an X–Y drive mechanism connected to said gas spraying unit such that the gas spraying unit can be moved forward and backward and to the right and to the left relative to an upper surface of a wafer mounted to the chuck.

3. The apparatus of claim 1, wherein said gas guard comprises a frusto-conical portion having upper and lower openings, the upper opening being smaller than the lower opening.

4. The apparatus of claim 1, wherein said gas guard has holes extending through a wall thereof that delimits said chamber.

5. The apparatus of claim 1, wherein said gas injection tube comprises a plurality of nozzles.

6. The apparatus of claim 1, wherein the gas injection tube and the gas guard are formed of a material selected from the group consisting of tetrafluoroethylene, stainless steel, gold, and platinum.

7. The apparatus of claim 1, wherein the de-ionized water supplying means includes a plurality of de-ionized water supply lines each having an outlet disposed above said wafer chuck outside said chamber.

8. The apparatus of claim 1, wherein said gas supply means includes a plurality of sources of gas selected from the group consisting of ozone ($O_3$), hydrofluoric acid (HF), ammonia ($NH_3$), carbon dioxide ($CO_2$), sulfur oxide ($SO_2$), hydrogen ($H_2$), nitrogen ($N_2$), argon (Ar), isopropyl alcohol (IPA), and a combination of gases of the group.

9. The apparatus of claim 1, and further comprising a megasonic transducer attached to the gas spraying unit so as to transmit supersonic waves via the gas guard.

10. The apparatus of claim 1, wherein the gas supply means includes a mixer for mixing a plurality of gases, said mixer being disposed upstream of said gas injection tube.

11. A wafer cleaning apparatus comprising:

a rotary wafer chuck on which a wafer is to be mounted and rotated;

a gas spraying unit disposed above said wafer chuck, said gas spraying unit including a gas injection tube having an outlet oriented to inject gas towards a wafer mounted to the chuck, and an annular gas guard attached to and extending downwardly from said gas injection tube, said annular gas guard defining a chamber beneath the outlet of said gas injection tube, the chamber having an open bottom;

a source of de-ionized water, and at least one de-ionized water supply line extending from said source of de-ionized water to a location outside said chamber and directly above an outer peripheral portion of said wafer chuck, to thereby provide a layer of de-ionized water on the wafer; and a source of cleaning gas connected to said gas injection tube such that the gas issues from the tube and is confined by said chamber to thereby reduce the thickness of the layer of de-ionized water provided on the wafer, whereby dissolving the gases into the layer of water is facilitated on the wafer.

12. The apparatus of claim 11, and further comprising a drive mechanism that moves said gas spraying unit relative to a wafer mounted to said chuck relative to one another in a plane parallel to an upper surface of the wafer, whereby the upper surface of the wafer can be scanned with gas issuing from the gas injection tube of said gas spraying unit.

13. The apparatus of claim 11, wherein said gas guard comprises a frusto-conical portion having upper and lower openings, the upper opening being smaller than the lower opening.

14. The apparatus of claim 11, wherein said gas guard has holes extending through a wall thereof that delimits said chamber.

15. The apparatus of claim 11, wherein said gas injection tube comprises a plurality of nozzles, and said source of cleaning gas is connected to at least one of said nozzles.

16. The apparatus of claim 15, and further comprising a source of isopropyl alcohol connected to one of said nozzles, whereby a wafer mounted to said rotary chuck can be dried.

17. The apparatus of claim 15, wherein said cleaning gas includes at least one gas selected from the group consisting of ozone ($O_3$), hydrofluoric acid (HF), ammonia ($NH_3$), carbon dioxide ($CO_2$), sulfur oxide ($SO_2$), hydrogen ($H_2$), nitrogen ($N_2$), argon (Ar), isopropyl alcohol (IPA).

18. The apparatus of claim 11, and further comprising a megasonic transducer attached to the gas spraying unit so as to transmit supersonic waves via the gas guard.

19. A single type of semiconductor wafer cleaning apparatus comprising:

a rotary wafer chuck on which a wafer is to be mounted and rotated;

a gas spraying unit disposed above said wafer chuck, said gas spraying unit including a gas injection tube oriented to inject gas towards a wafer mounted to the chuck, and a gas guard connected to the gas injection tube, said gas guard defining a chamber having an open bottom adjacent the rotary chuck, and said gas guard having holes extending through a wall thereof that delimits said chamber;

de-ionized water supply means for supplying de-ionized water onto a wafer at a location outside said chamber when the wafer is mounted to the chuck, to thereby provide a layer of de-ionized water on the wafer; and gas supply means for supplying gas to the gas injection tube.

20. A single type of semiconductor wafer cleaning apparatus comprising:

a rotary wafer chuck on which a wafer is to be mounted and rotated;

a gas spraying unit disposed above said wafer chuck, said gas spraying unit including a gas injection tube oriented to inject gas towards a wafer mounted to the chuck, and a gas guard connected to the gas injection tube, said gas guard defining a chamber having an open bottom adjacent the rotary chuck;

a megasonic transducer attached to the gas spraying unit so as to transmit supersonic waves via the gas guard;

de-ionized water supply means for supplying de-ionized water onto a wafer at a location outside said chamber when the wafer is mounted to the chuck, to thereby provide a layer of de-ionized water on the wafer; and gas supplying means for supplying gases to the gas injection tube.

* * * * *